US008462879B2

(12) United States Patent
Dybdal et al.

(10) Patent No.: US 8,462,879 B2
(45) Date of Patent: Jun. 11, 2013

(54) SYSTEMS AND METHODS FOR INCREASING COMMUNICATIONS BANDWIDTH USING NON-ORTHOGONAL POLARIZATIONS

(75) Inventors: Robert B. Dybdal, Palos Verdes, CA (US); Samuel J. Curry, Redondo Beach, CA (US); Flavio Lorenzelli, Los Angeles, CA (US); Don J. Hinshilwood, Torrance, CA (US)

(73) Assignee: The Aerospace Corporation, El Segundo, CA (US)

( * ) Notice: Subject to any disclaimer, the term of this patent is extended or adjusted under 35 U.S.C. 154(b) by 0 days.

(21) Appl. No.: 13/364,638

(22) Filed: Feb. 2, 2012

(65) Prior Publication Data

US 2013/0016793 A1 Jan. 17, 2013

Related U.S. Application Data

(63) Continuation of application No. 13/182,794, filed on Jul. 14, 2011, now Pat. No. 8,199,851.

(51) Int. Cl.
*H01Q 21/06* (2006.01)
*H01Q 21/24* (2006.01)

(52) U.S. Cl.
USPC ..... 375/295; 342/188; 342/361

(58) Field of Classification Search
USPC ..... 375/295, 377; 455/562, 561, 276.1, 455/139; 342/154, 188, 361, 368, 367, 359, 342/82; 398/152, 65, 68, 77, 78
See application file for complete search history.

(56) References Cited

U.S. PATENT DOCUMENTS

| | | | | |
|---|---|---|---|---|
| 4,087,818 | A | 5/1978 | Kreutel, Jr. | |
| 4,292,685 | A | 9/1981 | Lee | |
| 4,344,048 | A | 8/1982 | Morz | |
| 4,623,891 | A * | 11/1986 | Johnson | 342/361 |
| 5,701,591 | A | 12/1997 | Wong | |
| 6,026,121 | A | 2/2000 | Sadjadpour | |
| 6,201,785 | B1 | 3/2001 | Fouche et al. | |
| 6,442,214 | B1 | 8/2002 | Boleskei et al. | |
| 6,646,599 | B1 | 11/2003 | Apa et al. | |
| 6,910,177 | B2 | 6/2005 | Cox | |

(Continued)

OTHER PUBLICATIONS

Albera et al., "ICAR: a tool for blind source separation using fourth-order statistics only," IEEE Transactions on Signal Processing 53(10): 3633-3643, Oct. 2005.

(Continued)

*Primary Examiner* — Aristocratis Fotakis
(74) *Attorney, Agent, or Firm* — Jones Day; Jaime D. Choi

(57) ABSTRACT

Systems and methods for increasing communications bandwidth using non-orthogonal polarizations are provided herein. Under one aspect, a method of transmitting M independent signals, where M is at least 3, includes receiving the M signals from respective sources; at a transmitter polarization module, obtaining first and second linear combinations of the M signals; providing the first and second linear combinations to first and second input ports of a transmitter antenna; and transmitting with the transmitter antenna the first linear combination at a first polarization and the second linear combination at a second polarization orthogonal to the first polarization. The method may further include receiving at a receiver antenna the first linear combination at the first polarization, and the second linear combination at the second polarization; obtaining at receiver circuitry the M signals based on the received first and second linear combinations; and outputting the M signals on respective output ports.

20 Claims, 11 Drawing Sheets

LC1 = S1 + ½S2 + ½S4
LC2 = S3 + ½S2 − ½S4

U.S. PATENT DOCUMENTS

| | | | | |
|---|---|---|---|---|
| 7,092,452 | B2 | 8/2006 | Taylor et al. | |
| 7,123,579 | B1 | 10/2006 | Lyu | |
| 7,310,379 | B2 | 12/2007 | Sibecas et al. | |
| 7,330,801 | B2 | 2/2008 | Goldberg et al. | |
| 7,348,923 | B2 | 3/2008 | Goldberg | |
| 7,408,508 | B2 | 8/2008 | Goldberg | |
| 7,414,579 | B2 | 8/2008 | Kostanic et al. | |
| 7,746,828 | B2 | 6/2010 | Jalali | |
| 7,920,461 | B2 | 4/2011 | Little et al. | |
| 2001/0036843 | A1* | 11/2001 | Thompson | 455/562 |
| 2002/0018483 | A1 | 2/2002 | Kuwabara et al. | |
| 2002/0077071 | A1 | 6/2002 | Williams et al. | |
| 2003/0020646 | A1* | 1/2003 | Yu | 342/17 |
| 2003/0123381 | A1 | 7/2003 | Zhuang et al. | |
| 2004/0046695 | A1* | 3/2004 | Brothers et al. | 342/427 |
| 2004/0125880 | A1 | 7/2004 | Emami et al. | |
| 2006/0077097 | A1 | 4/2006 | Dybdal et al. | |
| 2011/0032159 | A1* | 2/2011 | Wu et al. | 343/702 |
| 2011/0170637 | A1 | 7/2011 | Lorenzelli | |
| 2011/0205119 | A1* | 8/2011 | Timofeev et al. | 342/373 |
| 2011/0268168 | A1 | 11/2011 | Dybdal et al. | |

OTHER PUBLICATIONS

Bahl et al., "Optimal decoding of linear codes for minimizing symbol error rate," IEEE Transactions on Information Theory: 284-287, Mar. 1974.

Cardoso et al., "Blind signal separation: statistical principles," Proc. IEEE 86(10): 2009-2025, Oct. 1998.

Koetter et al., "Turbo equalization," IEEE SP Magazine: 67-80, Jan. 2004.

Rabiner, "A tutorial on hidden markov models and selected applications in speech recognition," Proc. IEEE 77(2): 257-286, Feb. 2989.

Tuchler et al, "Turbo equalization: principles and new results," IEEE Transactions on Communications 50(5): 754-767, May 2002.

Verdu, "Optimum multiuser detection," Cambridge Univ. Press, Chapter 4, pp. 154-233, 1998.

* cited by examiner

LC1 = S1 + ½S2 + ½S4
LC2 = S3 + ½S2 – ½S4

$$LC1 = S1 + \tfrac{1}{2}S2 + \tfrac{1}{2}S4$$
$$LC2 = S3 + \tfrac{1}{2}S2 - \tfrac{1}{2}S4$$

LC1 = S1 + ½S2 + ½S4
LC2 = S3 + ½S2 – ½S4

$$LC1 = S1 + \tfrac{1}{2}S2 + \tfrac{1}{2}S4$$

SYSTEMS AND METHODS FOR INCREASING COMMUNICATIONS BANDWIDTH USING NON-ORTHOGONAL POLARIZATIONS

CROSS-REFERENCE TO RELATED APPLICATIONS

This application is a continuation under 35 U.S.C. §120 of U.S. patent application Ser. No. 13/182,794, filed Jul. 14, 2011 now U.S. Pat. No. 8,199,851 and entitled "Systems and Methods for Increasing Communications Bandwidth Using Non-Orthogonal Polarizations," the entire contents of which are incorporated by reference herein.

FIELD

This application generally relates to systems and methods for increasing communications bandwidth.

BACKGROUND

Increasing communications bandwidth is desirable because it facilitates more rapid transfer of information. In one technique for increasing bandwidth, referred to as "polarization reuse," two separate information streams are transmitted as two orthogonal signals, using two orthogonally oriented antennas. The signals are received by two orthogonally oriented antennas, each of which receives one of the two orthogonal signals and is coupled to a receiver that interprets the signal received by that antenna to obtain the corresponding information stream. Such an arrangement enables twice as much information to be transmitted as would be possible with an antenna having only a single polarization. In principle, ideal polarization orthogonality provides perfect isolation between the two independent signal components; in practice, only nominal orthogonality is achieved, and a means to achieve sufficient isolation is required to avoid signal reception degradation.

However, to successfully interpret both of the information streams generated during polarization reuse, past approaches have stringently controlled cross-coupling between the two orthogonal signals by passive and/or adaptive design techniques. For example, if one of the receiving antennas receives contributions from both of the signals, then it may become difficult for the corresponding receiver to interpret the signal to obtain the corresponding information stream. Much effort has been put forth to avoid cross-coupling between orthogonal signals. For example, passive antenna design techniques may be used to enhance the polarization purity of each of the two signals. Or, for example, active design techniques may be used to dynamically maintain signal isolation through adaptive cross polarization cancellation networks.

SUMMARY OF INVENTION

Embodiments of the present invention provide systems and methods for increasing communications bandwidth using non-orthogonal polarizations. These embodiments expand the available communication bandwidth by communicating multiple (>2) independent signals using non-orthogonal polarizations and separating and combining the independent signal components using signal processing techniques.

Under one aspect, a system for transmitting at least first, second, and third independent signals includes a transmitter subsystem comprising a transmitter polarization module and a transmitter antenna. The transmitter polarization module has at least first, second, and third transmitter input ports, transmitter circuitry, and first and second transmitter output ports. The transmitter circuitry is configured to receive the signals from the transmitter input ports and to output first and second linear combinations of the signals respectively on the first and second transmitter output ports. The transmitter antenna configured to receive the first and second linear combinations from the first and second transmitter output ports, and to transmit the first linear combination at a first polarization and to transmit the second linear combination at a second polarization orthogonal to the first polarization.

In some embodiments, the transmitter circuitry includes a first plurality of interconnected hybrid transformers disposed between and operably coupled to the at least first, second, and third transmitter input ports and the first and second output ports and configured to obtain the first and second linear combinations. A first one of the hybrid transformers may divide the first signal into first and second portions, and may provide the first portion to the first output port and the second portion to the second output port. That hybrid transformer also may place the first and second portions out of phase with one another. A second one of the hybrid transformers may add the second signal to the first portion, and a third one of the hybrid transformers may add the third signal to the second portion.

Some embodiments further include a receiver subsystem having a receiver antenna and receiver circuitry. The receiver antenna is configured to receive the first and second transmitted linear combinations and to output the first and second linear combinations respectively on first and second receiver output ports. The receiver circuitry has at least first, second, and third signal output ports, and is configured to receive the first and second linear combinations from the first and second receiver output ports. The receiver circuitry further is configured to obtain the at least first, second, and third signals based on the received first and second linear combinations, and to output the obtained at least first, second, and third signals respectively on the at least first, second, and third signal output ports.

The receiver circuitry may, in some embodiments, include a second plurality of interconnected hybrid transformers disposed between and operably coupled to the first and second receiver output ports and the at least first, second, and third signal lines and configured to obtain the at least first, second, and third signals. For example, the second plurality of interconnected hybrid transformers may be configured to obtain the at least first, second, and third signals based on a plurality of linear combinations of the received first and second linear combinations. The receiver circuitry optionally may further include an adaptive cancellation module configured to cancel residual cross-talk between the outputted at least first, second, and third signals.

In other embodiments, the receiver circuitry includes a signal separator module comprising a channel estimator and a signal separator. The channel estimator is configured to store a priori data describing a channel parameter of at least one of the first, second, and third independent signals and to dynamically estimate a channel parameter of that signal based on the a priori data. The signal separator is configured to obtain the first, second, and third independent signals based on the dynamically estimated channel parameter and the first and second linear combinations. The signal separator module also may include a performance monitor coupled to the channel estimator and the signal separator and configured to evaluate performance of the signal separator.

The a priori data may include information about a modulation format, code rate, bit rate, pulse shape, error correction code, interleaver description, preamble description, nominal carrier rate, or nominal data rate of one of the signals. The dynamically determined channel parameter may include a carrier frequency, carrier phase, code phase, bit timing, signal amplitude, or data rate refinement.

A common feature of these embodiments is the ability to control the channel parameters of the independent signals by design. Common frequency references would be available at both the transmitter and receiver respectively. Thus, carrier frequency differences between the independent signal components can be derived from these references. Similarly, bit timing and code phase differences between the independent signal components can be established at the transmitter and the differences between the channel parameters can be used in the signal separation process. Likewise, digital modulation techniques commonly format signals in blocks having a preamble. Different preambles can be assigned to the independent signals and these preamble differences can be effective in signal acquisition and tracking of the independent signal components, Under another aspect, a method of transmitting at least first, second, and third independent signals includes receiving at least first, second, and third independent signals from respective sources; at a transmitter polarization module, obtaining first and second linear combinations of the received at least first, second, and third signals; providing the first and second linear combinations to first and second input ports of a transmitter antenna; and transmitting with the transmitter antenna the first linear combination at a first polarization and the second linear combination at a second polarization orthogonal to the first polarization.

The first linear combination may include the first signal and a first portion of the second signal, and the second linear combination may include the third signal and a second portion of the second signal, wherein the first and second portions of the second signal are out of phase with one another.

In some embodiments, obtaining the first and second linear combinations includes applying the at least first, second, and third signals to a network of hybrid transformers.

The method may further include receiving at a receiver antenna the first linear combination at the first polarization, and the second linear combination at the second polarization; obtaining at receiver circuitry the at least first, second, and third signals based on the received first and second linear combinations; and outputting the obtained at least first, second, and third signals on at least first, second, and third signal output ports.

Obtaining the at least first, second, and third signals at the receiver circuitry may include, in some embodiments, applying the received first and second linear combinations to a network of hybrid transformers. In other embodiments, obtaining the at least first, second, and third signals at the receiver circuitry comprises: storing a priori data describing a channel parameter of at least one of the first, second, and third independent signals; dynamically estimating a channel parameter of that signal based on the a priori data; and obtaining the first, second, and third independent signals based on the dynamically estimated channel parameter and the first and second linear combinations.

Under another aspect, a method of receiving at least first, second, and third independent signals includes receiving at a receiver antenna a first linear combination of at least first, second, and third independent signals at a first polarization; receiving at the receiver antenna a second linear combination of the at least first, second, and third independent signals at second polarization orthogonal to the first polarization; obtaining at receiver circuitry the at least first, second, and third independent signals based on the first and second linear combinations; and respectively outputting the obtained at least first, second, and third signals on at least first, second, and third signal output ports.

DETAILED DESCRIPTION

Embodiments of the present invention provide systems and methods for increasing information transfer in communications using non-orthogonally polarized signals. Specifically on the transmitter side, a polarization module combines multiple independent signals into first and second linear combinations, and provides those linear combinations to a transmitter antenna. The transmitter antenna then transmits the first linear combination at a first polarization (e.g., H), and the second linear combination at a second polarization that is orthogonal to the first (e.g., V). The composite signal transmitted by the antenna contains at least one non-orthogonal component corresponding to a particular one of the independent signals. This non-orthogonal component arises because each of the first and second linear combinations contains a portion of that particular signal. As such, when the transmitting antenna transmits the two linear combinations orthogonally to one another, the antenna transmits one portion of that signal at the first polarization, and another portion of the signal at the second polarization, and the sum of those two portions is a linear polarization that is non-orthogonal to the first or the second polarization.

Figure 1:
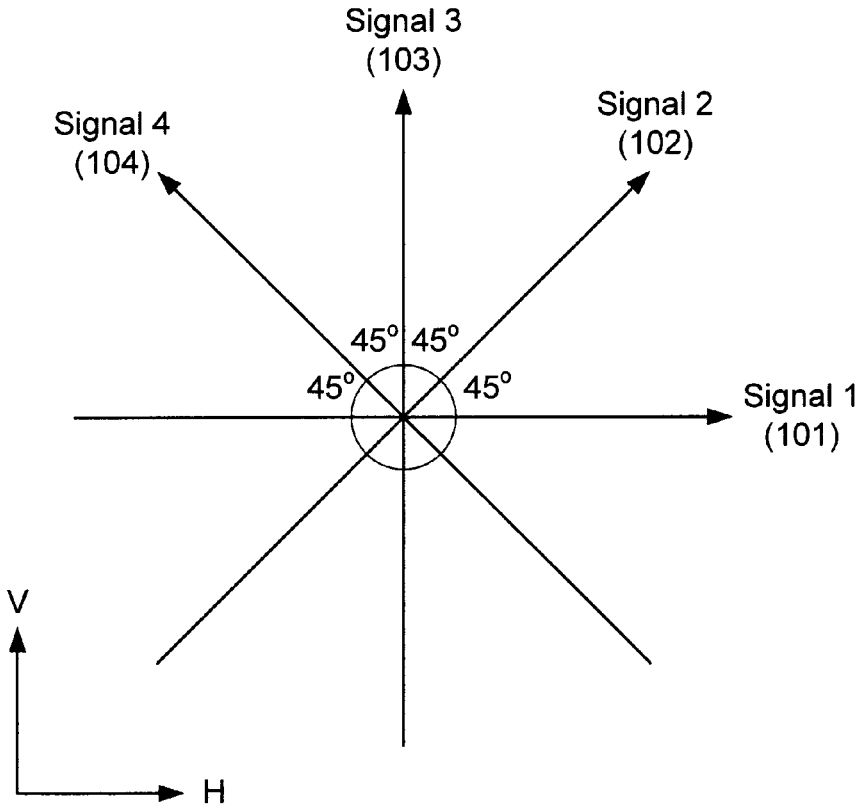
FIG. 1 schematically illustrates the polarizations of four non-orthogonal signals that may be transmitted and received using a system for increasing communications bandwidth using non-orthogonal polarizations, according to one exemplary embodiment of the present invention.

For example, as illustrated in FIG. 1, where four independent signals are communicated, the first and second linear combinations may be selected such that signal 1 (101) is transmitted at the H polarization, and signal 3 (102) is transmitted at the V polarization. The first linear combination, which is transmitted at the H polarization, contains a component of signal 1 but no component of signal 3, and as a result signal 3 has no H component and is entirely V polarized. Conversely, the second linear combination, which is transmitted at the V polarization, contains a component of signal 3 but no component of signal 1, and as a result signal 1 has no V component and is entirely H polarized. However, both of the first and second linear combinations contain components of signals 2 and 4, so both of these signals have components in both of the H and V directions, and are therefore non-orthogonal to the H and V directions. Specifically, the first linear combination contains half of signal 2, and the second linear combination contains the other half. The sum in polarization space of the signal 2 contributions therefore appears midway between the V and H polarizations. Similarly, the first linear combination contains half of signal 4, but with an opposite phase to that of signal 2, and the second linear combination contains the other half. The sum in polarization space of the signal 4 contributions therefore appears between the V and H polarizations, but with opposite phase to that of signal 2 in the H direction. Accordingly, by controlling the particular proportions and phases of the signal components included in the first and second linear combinations, the polarization of each individual signal may be selected to be any desired angle. The receiver side includes a receiver antenna that receives the first and second linear combinations transmitted by the transmitter antenna on orthogonal polarizations, and circuitry that separates the different signals from one another. The bandwidth of the communications system thus may be increased dramatically, by allowing multiple signals to be transmitted at non-orthogonal polarizations to one another, even if the bandwidths of one or more of the signals overlap with one another. Specifically, in comparison to the conventional dual polarization designs that allow two independent signals to share the same bandwidth, in this example, four independent signals share the bandwidth increasing the communication throughput by a factor of two compared to conventional dual polarization designs.

Figure 2:
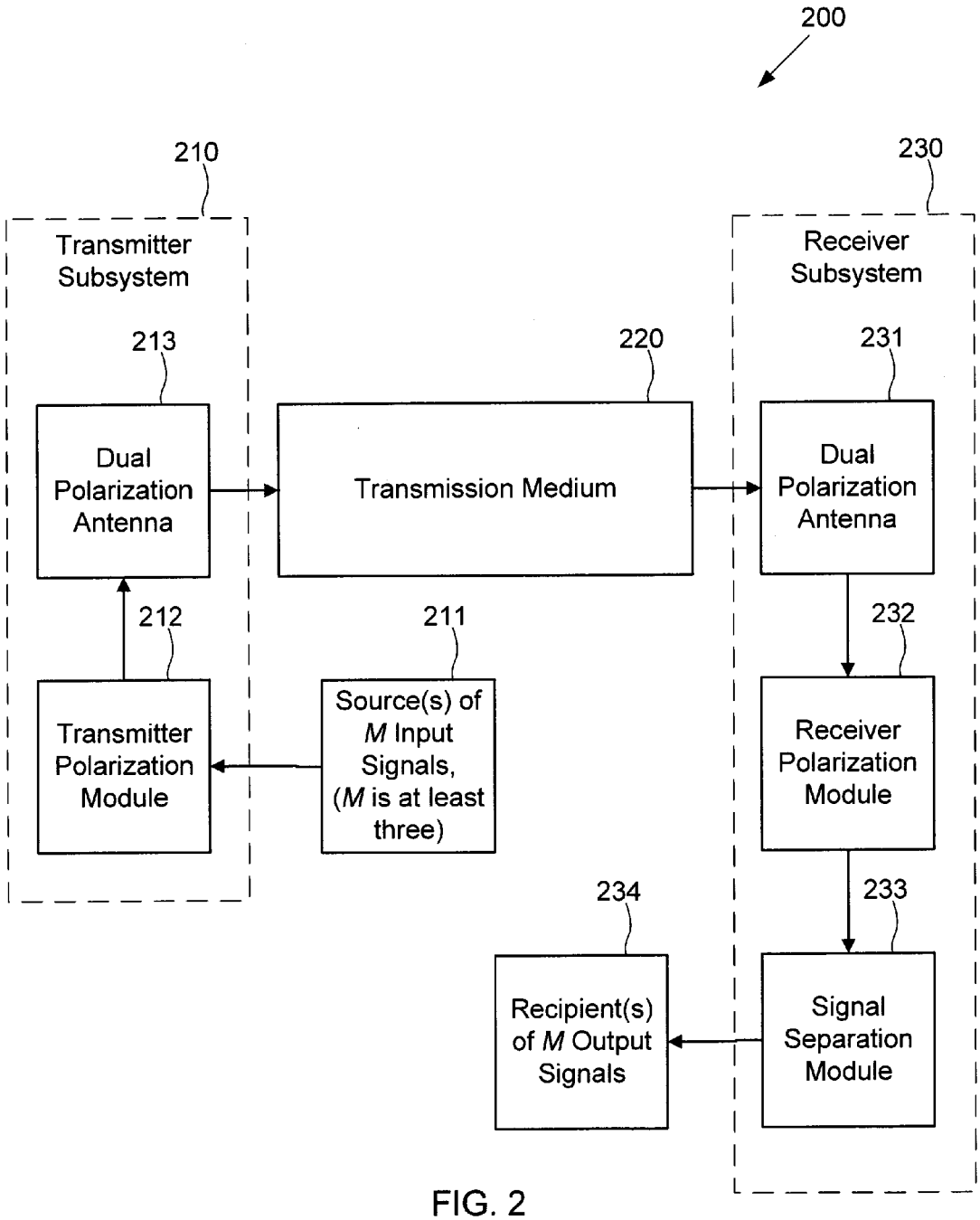
FIG. 2 is a high-level block diagram of components of a communications system for increasing communications bandwidth using non-orthogonal polarizations, according to some embodiments of the present invention.

FIG. 2 illustrates a high level overview of a communications system 200 for transmitting a plurality M of independent signals at non-orthogonal polarizations. Communications system 200 includes transmitter subsystem 210 and receiver subsystem 230. Transmitter subsystem 210 includes transmitter polarization module 212 and dual polarization antenna 213. Transmitter polarization module 212 includes input ports on which it receives M input signals from M corresponding sources 211, where M is at least three. Transmitter polarization module 212 also includes circuitry configured to receive these signals from the input ports and to obtain first and second linear combinations of the signals, for example using a network of hybrid transformers such as described in greater detail below with respect to FIG. 4. Transmitter polarization module 212 provides those linear combinations on respective output ports to dual polarization antenna 213, which transmits the first linear combination at a first polarization (e.g., H) and the second linear combination at a second, orthogonal polarization (e.g., V).

The linear combinations pass through transmission medium 220 and then are received by receiver subsystem 230, which includes dual polarization antenna 231, receiver polarization module 232, and optional signal separation module 233 in the illustrated embodiment. Dual polarization antenna 231 receives the first linear combination at the first polarization, and the second linear combination at the second polarization, and then provides the first and second linear combinations to the receiver polarization module 232 on corresponding ports. The receiver polarization module 232 then obtains the M signals based on the first and second linear combinations, for example by obtaining a plurality of linear combinations of the first and second linear combinations, as described in greater detail below with respect to FIG. 5. The receiver polarization module 232 then provides the M signals via M output ports to the optional signal separation module 233, which further processes the signals so as to reduce cross-talk and improve signal quality. The signal separation module 233 (or the receiver polarization module 232 if the signal separation module is not included) then provides the M signals via M output ports to one or more recipient(s) of the M output signals 234. As discussed in greater detail below with respect to FIGS. 6 and 7, circuitry other than the illustrated receiver polarization module 232 and signal separation module 233 may be used to obtain the M signals.

Figure 3A:
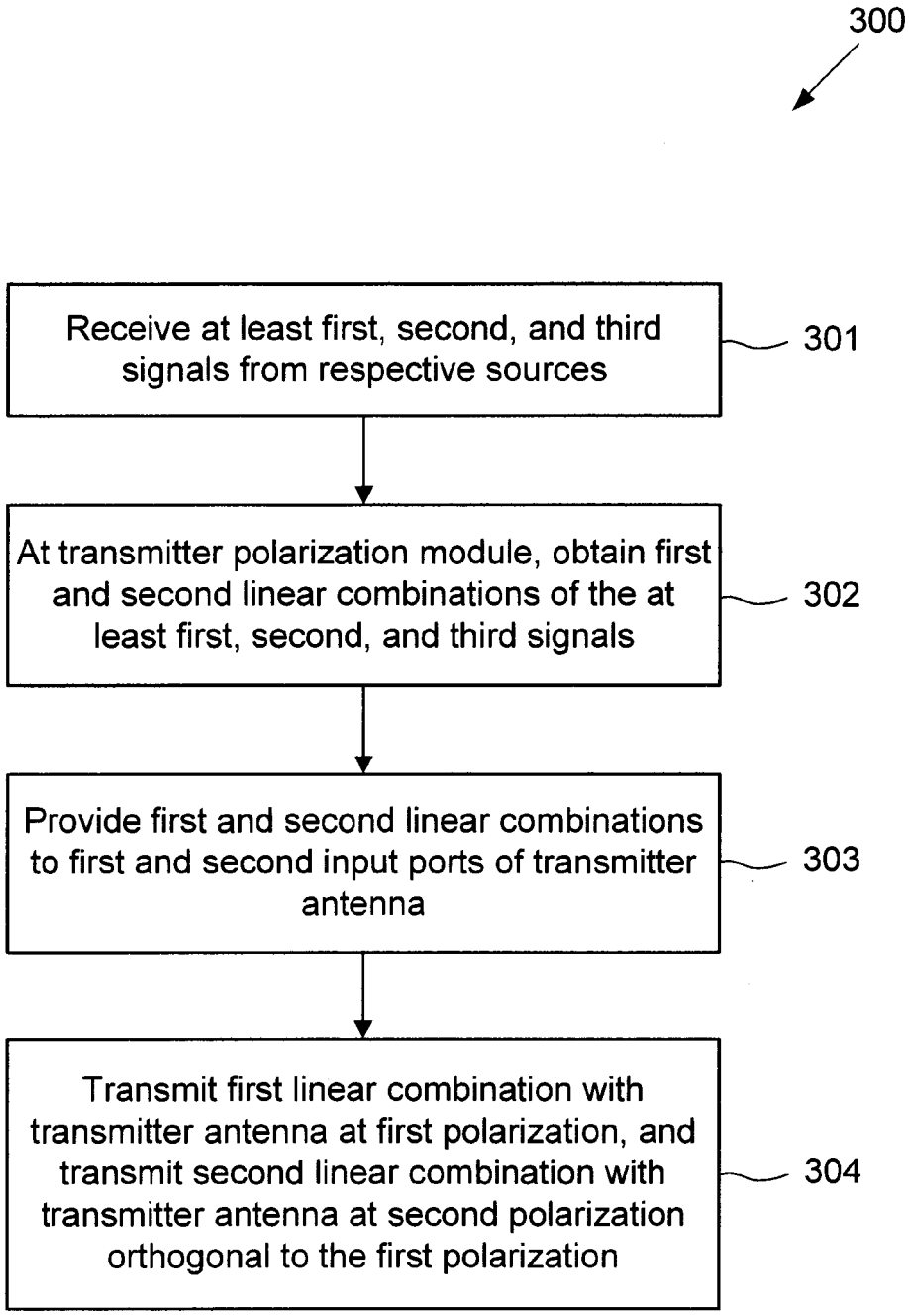
FIG. 3A illustrates steps performed by a transmitter subsystem during a method for increasing communications bandwidth using non-orthogonal polarizations, according to some embodiments of the present invention.
Figure 3B:
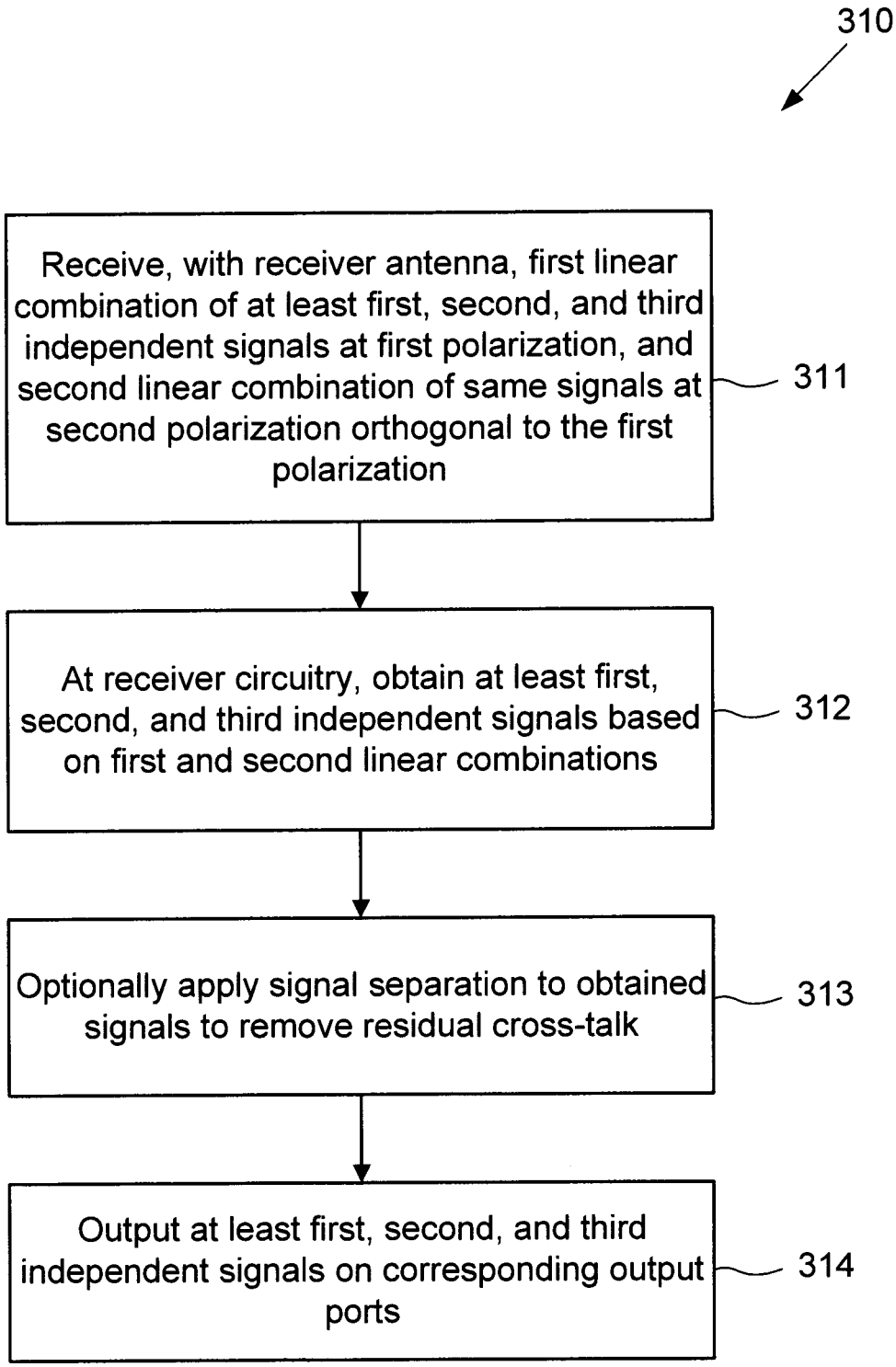
FIG. 3B illustrates steps performed by a receiver subsystem during a method for increasing communications bandwidth using non-orthogonal polarizations, according to some embodiments of the present invention.

FIGS. 3A and 3B illustrate steps in a method of transmitting at least three signals, for example using system 200 illustrated in FIG. 2. FIG. 3A illustrates steps of a method 300 that may be performed on the transmitter side, e.g., using transmitter subsystem 210, while FIG. 3B illustrates steps of a method 310 that may be performed on the receiver side, e.g., using receiver subsystem 230.

Referring to FIG. 3A, method 300 includes receiving first, second, and third signals from respective sources (step 301). For example, the sources may provide the signals wirelessly, or via a wired connection, to corresponding first, second, and third input ports of a transmitter polarization module such as module 212 illustrated in FIG. 2.

Method 300 further includes, at the transmitter polarization module, obtaining first and second linear combinations of the first, second, and third signals (step 302). For example, the transmitter polarization module may include dedicated hardware configured to perform summation, subtraction, and/or division operations on the first, second, and third signals, and to provide as output first and second linear combinations of those signals. The first and second linear combinations are different from one another. As mentioned above with respect to FIG. 1, the first linear combination may include components of some, but not all, of these signals, and similarly the second linear combination may include components of some, but not all, of the signals. The particular proportion and phase (plus or minus sign) of each signal's contribution in each of the two linear combinations determines the polarization of that signal as it is transmitted to a receiver antenna. As described in greater detail below with respect to FIG. 4, one way of obtaining such linear combinations is with a network of hybrid transformers.

Method 300 includes providing the first and second linear combinations to first and second input ports of a transmitter antenna (step 303), and then transmitting the first linear combination with the transmitter antenna at a first polarization, and transmitting the second linear combination with the transmitter antenna at a second polarization (step 304).

Steps performed on the receiver side will now be described with reference to method 310 illustrated in FIG. 3B.

Method 310 includes receiving, with a receiver antenna, a first linear combination of at least first, second, and third independent signals at a first polarization, and a second linear combination of these same signals at a second polarization orthogonal to the first polarization (step 311). Such first and second linear combinations may, for example, be generated by a transmitter subsystem 210 such as illustrated in FIG. 2, using methods such method 300 illustrated in FIG. 3.

Method 310 also includes, at receiver circuitry, obtaining the at least first, second, and third independent signals based on the first and second linear combinations (step 312). As described in further detail below with respect to FIG. 5, one way of doing this is using a network of hybrid transformers. Or, as described in further detail below with respect to FIGS. 6-7, another way of doing this is using a signal separator module.

Still referring to FIG. 3B, method 310 optionally includes applying adaptive cancellation to the obtained at least first, second, and third signals to remove residual cross-talk (step 313). For example, if a network of hybrid transformers is used to obtain the at least first, second, and third signals, practical limitations on that network may result in a relatively small amount of residual cross-talk between the signals. Adaptive cancellation techniques known in the art may be used to reduce or eliminate that cross-talk, for example using signal separation module 233 illustrated in FIG. 2. For further details on adaptive cancellation of cross-talk, see, for example, U.S. Pat. No. 4,292,685 to Lee, the entire contents of which are incorporated by reference herein.

Method 310 also includes outputting the at least first, second, and third independent signals on corresponding output ports (step 314). For example, as illustrated in FIG. 2, the receiver polarization module 232 or optional signal separation module 233 may provide the signals to one or more recipients. The output ports may provide the signals to the recipient(s) via any suitable wired or wireless connection.

Further structural details of transmitter polarization module 212 illustrated in FIG. 2 will now be described with reference to FIG. 4. Details of receiver polarization module 232 will be described further below with reference to FIG. 5. Alternative embodiments will then be described.

Figure 4:
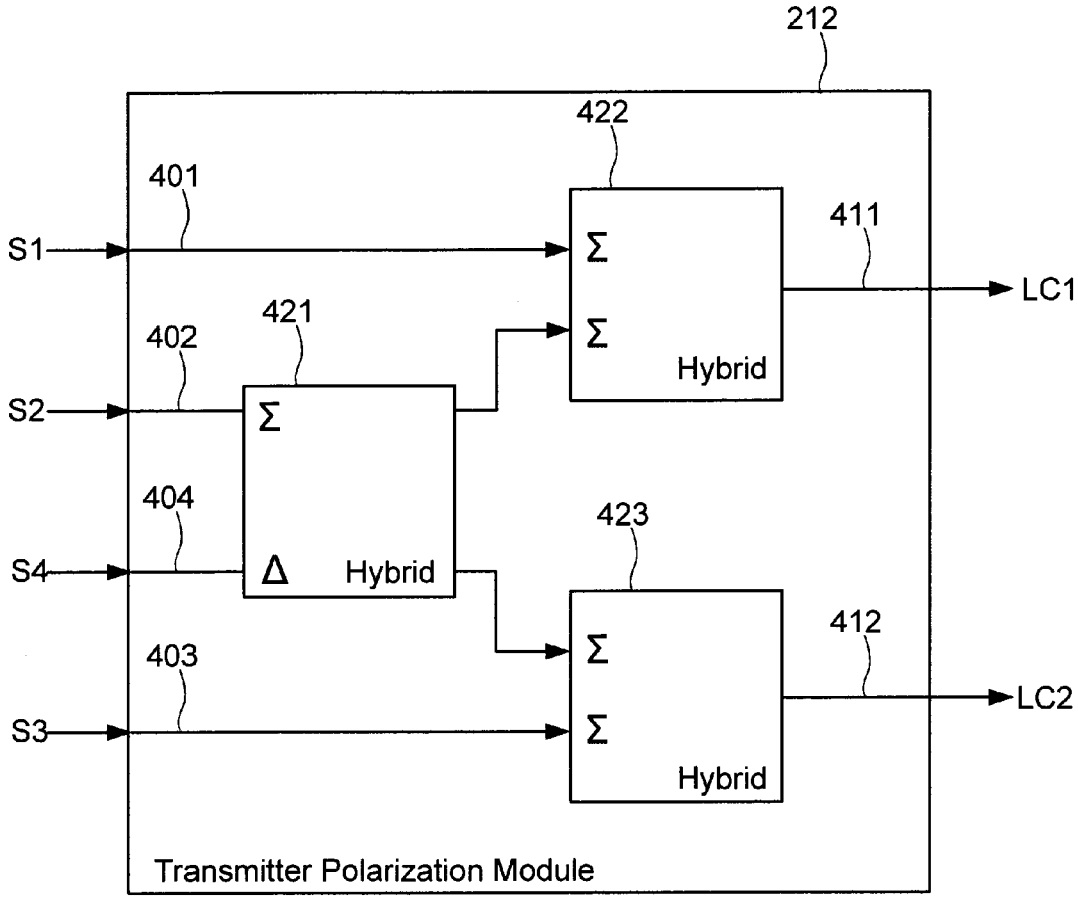
FIG. 4 schematically illustrates a transmitter polarization module for use in the communications system of FIG. 2 or the system of FIG. 6 and configured to process four signals, according to one exemplary embodiment of the present invention.

FIG. 4 illustrates an exemplary transmitter polarization module 212 that may be used in a transmitter subsystem 210 such as illustrated in FIG. 2. The transmitter polarization module 212 includes four input ports 401, 402, 403, 404, on which the module respectively receives as input four incoming signals S1, S2, S3, S4. Transmitter polarization module 212 also includes first and second output ports 411, 412, on which it outputs first and second linear combinations LC1, LC2 of the four signals. As discussed in greater detail below, other embodiments may take as input other numbers of signals. However, such embodiments have the common feature that they have only two output ports, for providing first and second linear combinations of those signals to a transmission antenna for respective transmission at orthogonal polarizations to one another. Each of the linear combinations may include a signal component that the other linear combination lacks.

Transmitter polarization module 212 includes first, second, and third hybrid transformers 421, 422, 423 disposed between, and operably coupled to, input ports 401-403 and output ports 411, 412. Each hybrid transformer, also referred to as a "hybrid," has two inputs, which can either be "sum" or "difference" inputs, and one or two outputs. The inputs of first hybrid 421 are respectively coupled to input ports 402, 404, which respectively receive signals S2 and S4. Note that the input receiving signal S4 is a difference input, denoted A in FIG. 4, while the other hybrid inputs are all sum inputs, denoted Σ. The outputs of first hybrid 421 are respectively coupled to the inputs of the second and third hybrids 422, 423. The other input of second hybrid 422 is coupled to input port 401, which receives signal S1, and the output of second hybrid 422 is coupled to output port 411. The other input of third hybrid 423 is coupled to input port 403, which receives signal S3, and the output of third hybrid 423 is coupled to output port 412.

Transmitter polarization module 212 obtains and outputs first and second linear combinations LC1, LC2 of signals S1, S2, S3, and S4 as follows. First hybrid 421 receives S2 on a sum input and S4 on a difference input, provides to second hybrid 422 the sum ½S2+½S4, and provides to third hybrid 423 the difference ½S2−½S4. That is, the S4 terms provided to the second and third hybrids 422, 423 have opposite phase than one another. Second hybrid receives ½S2+½S4, as well as S1, both on sum inputs, and provides to output port 411 the first linear combination LC1=S1+½S2+½S4. Third hybrid receives ½S2−½S4, as well as S3, and provides to output port 412 the second linear combination LC2=S1+½S2−½S4. As described above with respect to FIG. 2, the output ports of transmitter polarization module 212 may be coupled to a transmission antenna configured to transmit the first and second linear combinations at polarizations orthogonal to one another, e.g., at H and V respectively.

Figure 5:
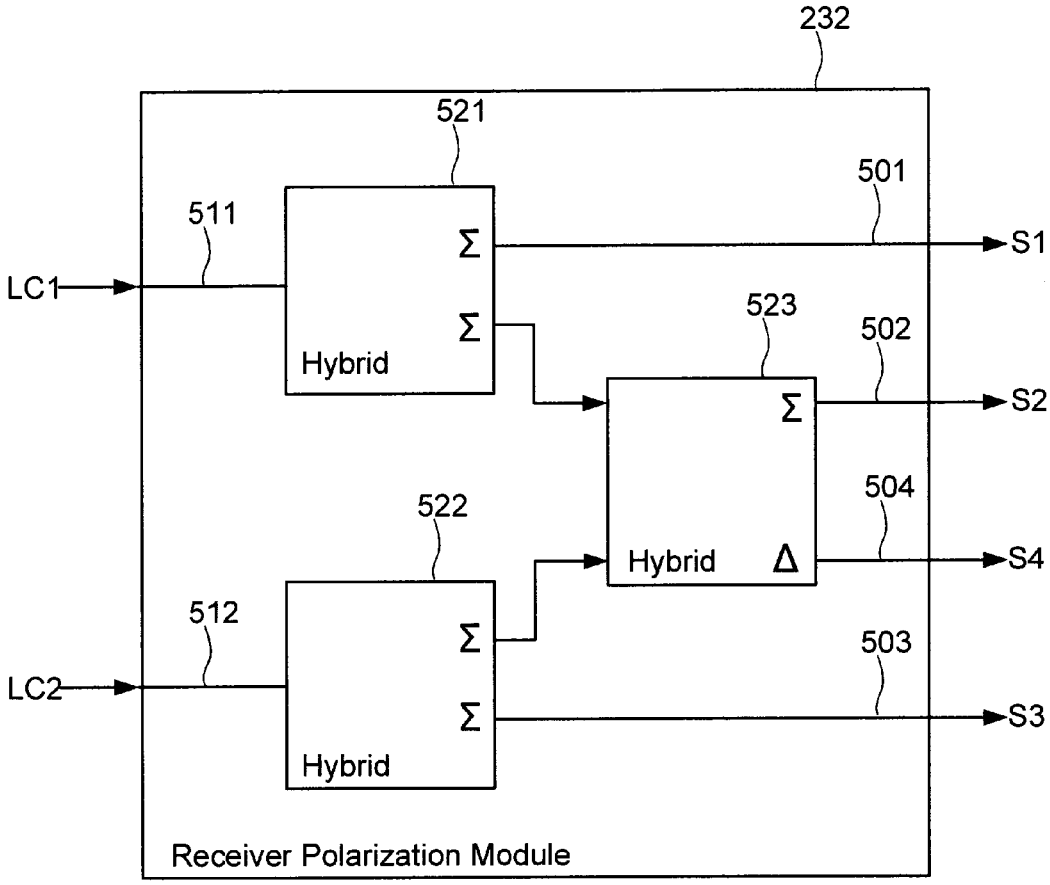
FIG. 5 schematically illustrates a receiver polarization module for use in the communications system of FIG. 2 and configured to process four signals, according to one exemplary embodiment of the present invention.
Figure 6:
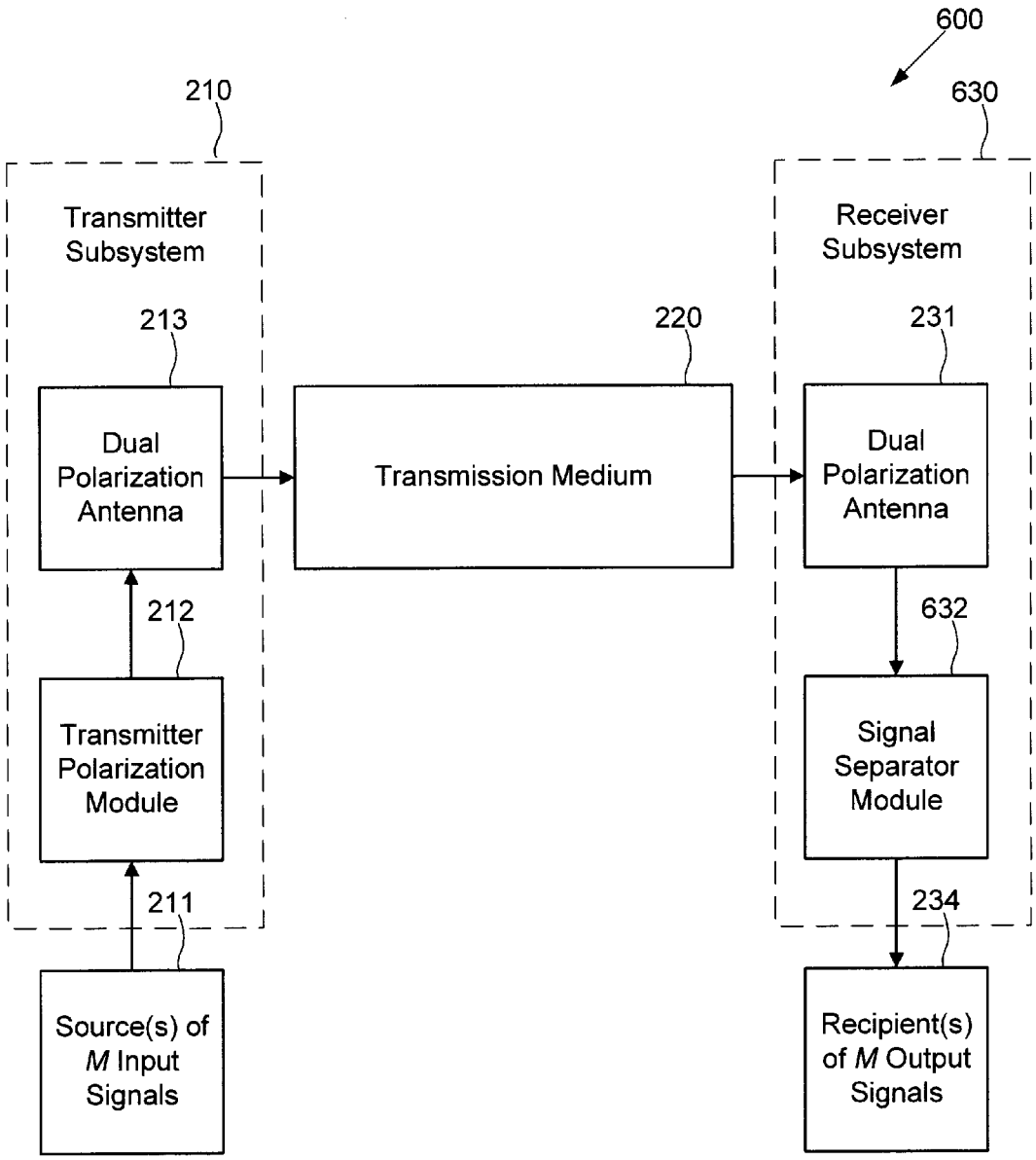
FIG. 6 is a high level block diagram of components of an alternative communications system for increasing communications bandwidth using multiple non-orthogonal polarizations, according to some embodiments of the present invention.

FIG. 5 illustrates an exemplary receiver polarization module 232 that may be used in a receiver subsystem 230 such as illustrated in FIG. 2. The receiver polarization module 232 includes two input ports 511, 512 on which the module respectively receives as input two incoming linear combinations LC1, LC2 from the receiver antenna. The receiver polarization module 232 also includes four output ports 501, 502, 503, 504, on which the module respectively outputs four signals S1, S2, S3, S4. Other embodiments may provide as output other numbers of signals, but have the common feature that they have only two input ports, for receiving first and second linear combinations of those signals from a receiver antenna, which received them at orthogonal polarizations to one another.

Receiver polarization module 232 includes first, second, and third hybrids 521, 522, 523 disposed between, and operably coupled to, input ports 511, 512 and output ports 501-504. Each hybrid has either one or two inputs and two outputs. The input to first hybrid 521 is coupled to input port 511, which receives first linear combination LC1 from the V-port of antenna 231. One output of first hybrid 521 is coupled to output port 501 and the other output is coupled to one of the inputs of third hybrid 523. The input to second hybrid 522 is coupled to input port 512, which receives second linear combination LC2 from the H-port of antenna 231. One output of second hybrid 522 is coupled to output port 503 and the other output is coupled to one of the inputs of third hybrid 523. The inputs of third hybrid 523 are respectively coupled to outputs of the first and second transformers 521, 522 as discussed above, and the outputs of the third hybrid are respectively coupled to output ports 502, 504.

Receiver polarization module 232 obtains and outputs signals S1, S2, S3, and S4 based on LC1 and LC2 as follows. First hybrid 521 receives LC1 (S1+½S2+½S4) as input from input port 511, provides S1 on the output coupled to output port 501, and provides ½S2+½S4 on the output coupled to third hybrid 523. Second hybrid 522 receives LC2 (S3+½S2−½S4) as input from input port 512, provides S3 on the output coupled to output port 503, and provides ½S2−½S4 on the output coupled to third hybrid 523. Third hybrid receives ½S2+½S4 on one input and ½S2−½S4 on the other input, provides S2 on the output coupled to output port 502, and provides S4 on the output coupled to output port 504.

Output ports 501-504 are optionally coupled to signal separation module 233, which is configured to reduce or eliminate residual cross-coupling between signals S1, S2, S3, and S4 using any suitable combination of hardware and software. For example, adding a unique additional code to each signal, e.g., a continuous wave (CW) tone or pseudorandom code, may facilitate adaptive cancellation of cross-coupling, as is known in the art. Residual cross-coupling between signals S1, S2, S3, and S4 alternatively may be reduced or eliminated using a signal separation module such as described below with respect to FIG. 7. If neither an adaptive cancellation module nor a signal separation module is used, then output ports 501-504 may be operably coupled to one or more recipients.

Note that although FIGS. 4 and 5 refer to the use of dedicated hardware configured to obtain linear combinations of signals, the transmitter and receiver polarization modules 212, 232 may be implemented using any suitable combination of dedicated hardware and/or general purpose computing platforms having appropriate programming. For example, one or more components of the polarization modules may be implemented using one or more programmable electronic circuits, such as programmable gate arrays (PGAs), application specific integrated circuits (ASICs), and/or processors, e.g., CPUs or GPUs. The programmable circuits may be programmed with associated software and/or firmware. In one embodiment, the transmitter and receiver polarization modules are implemented on a general-purpose computing platform, e.g., a personal computer (PC), that includes input ports, output ports, a processor, and computer-readable memory storing instructions for causing the processor to execute functionalities analogous to a suitably arranged network of hybrid transformers, that is, to obtain first and second linear combinations of signals provided on the input ports.

In still other embodiments, the receiver polarization module 232 may be omitted entirely, and the signals separated by other means. For example, the modified communications system 600 illustrated in FIG. 6 a transmitter subsystem 210 that is substantially the same as that discussed above with respect to FIG. 2, as well as a modified receiver subsystem 630 that includes a signal separator module 632 in place of receiver polarization module 232 and optional signal separation module 233. The receiver polarization module 232 illustrated in FIG. 5 and described in greater detail below passively separates the individual signal components, but may be used with the optional signal separator to address imperfections in the network hardware or other cross polarization contributions produced by the transmission medium 220. The signal separator module 632 uses signal processing techniques in place of the passive module 232. Signal separator module 632 includes a pair of input ports coupled to antenna 231, on which the module respectively receives the first and second linear combinations. Signal separator module 632 is configured to obtain M signals based on the first and second linear combinations, on a priori information describing channel parameter(s) of one or more of the M signals, and measured channel parameters of the individual signal components, and to output the M signals on corresponding output ports, to one or more recipients 234.

Figure 7A:
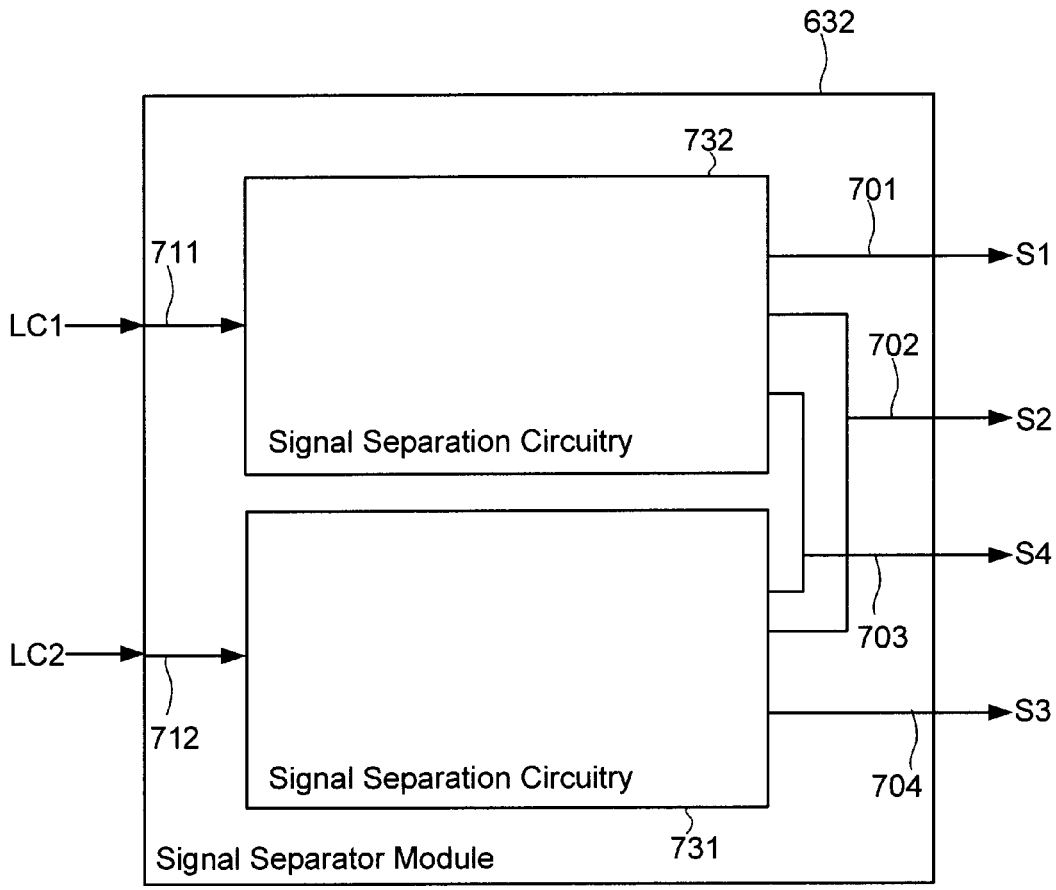
FIG. 7A schematically illustrates a signal separator module for use in the alternative communications system of FIG. 6 and configured to process four signals, according to one exemplary embodiment of the present invention.

FIG. 7A schematically illustrates an exemplary signal separator module 632 configured to separate four signals from one another based on two linear combinations of those signals following transmission using the non-orthogonal polarization scheme illustrated in FIG. 1. Signal separator module 632 includes first and second input ports 711, 712, first, second, third and fourth output ports 701, 702, 703, 704, and first and second signal separation circuitry components 731, 732. The first and second input ports 711, 712 are respectively coupled to the V and H ports of antenna 231, and respectively receive the first and second linear combinations for one of the polarizations LC1 or LC2 thereon. Signal separation circuitry component 732 is coupled to the first input port 711, on which it receives the composite of S1 and one half each of S2 and S4, and respectively outputs those separated signal components on output ports 701, 702, and 703. Signal separation circuitry component 731 is coupled to the second input port 712, on which it receives the composite of S3 and the difference between one half each of S2 and S4, and respectively outputs those separated signal components on output ports 704, 702, and 703. Accordingly, the S2 and S4 components, which are provided separately by components 731, 732, coherently combine at output ports 702, 703, so as to restore their full signal power. It should be appreciated that the configuration of module 632 may be modified suitably so as to separate other numbers of signals from one another.

Figure 7B:
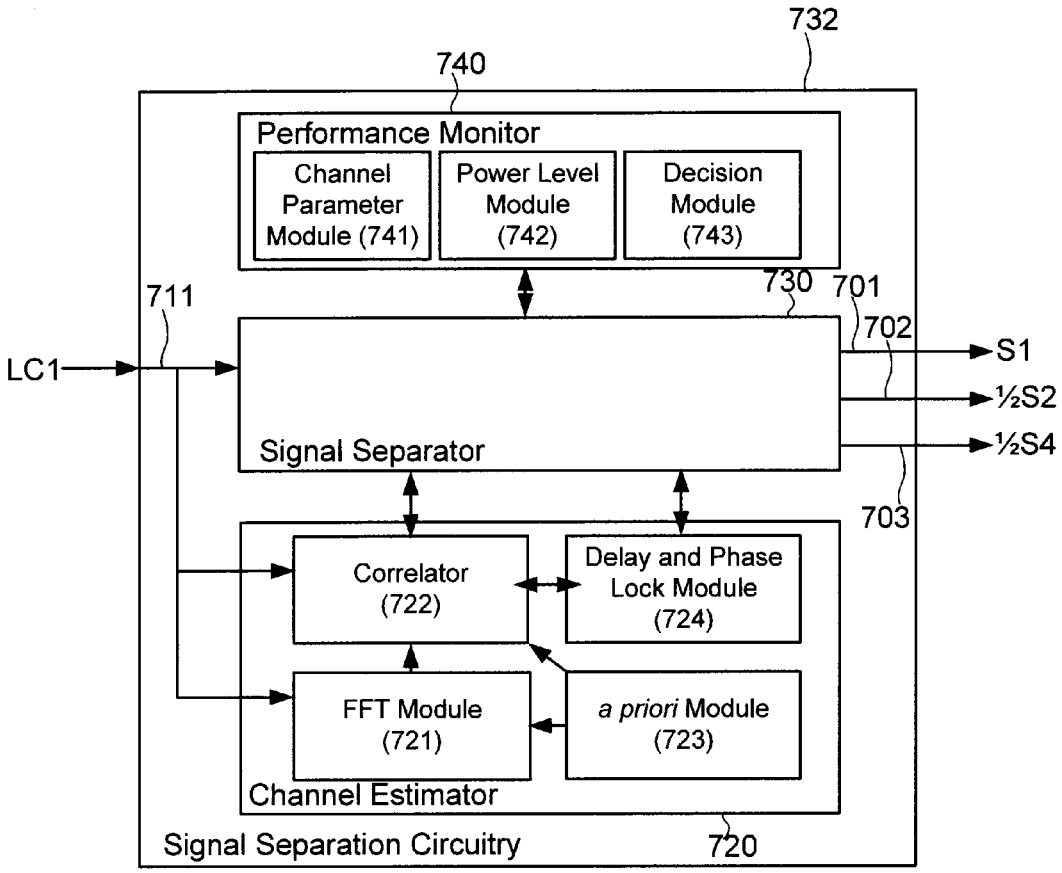
FIG. 7B schematically illustrates a signal separation circuitry component of the signal separator module of FIG. 7A, according to one exemplary embodiment of the present invention.

FIG. 7B illustrates in greater detail the components of signal separation circuitry component 732. Signal separation circuitry component 731 is substantially similar to component 732, except that the input and outputs are different, as discussed above with respect to FIG. 7A.

As illustrated in FIG. 7B, signal separation circuitry component 732 includes an input port 711, first, second, and third output ports 701, 702, and 703, channel estimator 720, signal separator 730, and performance monitor 740. Channel estimator 720 is coupled to the input port 711, and includes fast Fourier transform (FFT) module 721, correlator 722, a priori module 723, and delay and phase lock module 724. Signal separator 730 is coupled to the input port 711 and to output ports 701-703. Signal separator 730 is operably coupled both to channel estimator 720 and performance monitor 740, and is configured to execute one or more suitable signal separation algorithms that take as input LC1 and a priori information about the signals constituting LC1, and providing as output S1, ½S2, and ½S4. Performance monitor 740 is configured to monitor the output of signal separator 730, and includes channel parameter module 741, power level module 742, and decision module 743.

Channel estimator 720 is configured to use a priori information about one or more of signals S1, S2, and S4 to estimate channel parameters of one or more of those signals, and to use that a priori information to estimate channel parameters to signal separator 730 for use in separating the signals from each other. Specifically, channel estimator 720 receives linear combination of signals LC1 from input port 711 and provides that linear combination to FFT module 721, which periodically or continuously obtains a Fourier transform of LC1. The Fourier transform contains peaks corresponding to the carrier frequencies of the signals constituting the linear combination, e.g., the Fourier transform of LC1 contains peaks corresponding to the carrier frequencies of S1, S2, and S4. The shapes of these peaks reflect the channel parameters of the signals, for example, the carrier frequency, bandwidth, offset, modulation format, code rate, bit rate, pulse shape, error correction code, interleaver description, nominal carrier rate, and/or the nominal data rate of the signals. Indeed, the Fourier transform dynamically reflects any changes in these channel parameters of the signals over time, for example because of intentional frequency shifts, practical limitations in the system electronics and antenna design, or Doppler effects.

The a priori module 723 includes a storage medium that stores information that is known a priori (that is, information that is predetermined) about the signals. Such a priori information may include, for example, the carrier frequency, bandwidth, offset, modulation format, code rate, bit rate, pulse shape, code preambles, error correction code, interleaver description, nominal carrier rate, and/or nominal data rate of the signal(s), e.g., one or more types of information that also may be obtained using FFT module. FFT module 721 obtains such a priori information about the signals from a priori module 723 and uses such information while obtaining the Fourier transforms. For example, FFT module 721 may use a priori knowledge about the carrier frequencies of the signals to identify region(s) of the spectrum expected to contain the signals.

Correlator 722 receives as input the first linear combinations LC 1, dynamic information about the actual channel parameters of signals S1, S2, and S4 from FFT module 721, and a priori information about the channel parameters of one or more of those signals from a priori module 723. Correlator 722 then dynamically correlates these three inputs to identify and estimate the actual channel parameters of the signals, based on their actual and expected channel parameters. In particular, correlator 722 may use a priori knowledge of the signal preambles or headers to identify the signals, by comparing the actual preamble or header of the signals to the expected preamble or header. As such, even if the bit timing or code phase value of one or more of the signals varies, correlator 722 may still identify the signal using the preamble or header, in combination with information received from FFT module 721. Correlator 722 provides as output to the signal separator 730 and to the delay and phase lock module 724 information about the estimated channel parameters of one or more of the signals, in one embodiment all of the signals S1, S2, S4.

Phase lock module 724 is in operable communication with correlator 722 and signal separator 730, and is configured to use channel parameters, e.g., preamble or header information provided by correlator 722, to dynamically adjust for code phase and bit timing offsets between the signals.

Signal separator 730 takes as input the first linear combination LC1, as well as the estimated channel parameters provided by correlator 722, and provides as output separated signals S1, ½S2, and ½S4. Specifically, signal separator 730 separates LC1 into its constituent signals S1, ½S2, ½S4 based on the estimated signal parameters of S1, S2, and S4 that channel estimator 720 obtains based on a priori information about those signals. These constituent signals are then coherently combined with those that signal separation circuitry component 731 analogously obtains as illustrated in FIG. 7A. Specifically, the ½S2 signal component obtained from component 732's analysis of LC1 is combined with the ½S2 signal component obtained from component 731's analysis of LC2 at output port 702; and the ½S4 signal component obtained from component 732's analysis of LC1 is combined with the ½S4 signal component obtained from component 731's analysis of LC2, as illustrated in FIG. 7A. Such a summation further enhances the signal power of S2 and S4, which are each at half power in LC1 and LC2. Signals S1 and S3 are approximately at full strength in LC1 and LC2, respectively, and so generally are not summed with any residual components of those signals in LC2 or LC1, respectively.

Referring again to FIG. 7B, signal separator 730 of signal separation circuitry component 732 may apply any suitable algorithm to LC1 and the estimated channel parameters to separate signals S1, S2, and S4 from one another. One class of algorithms that may suitably be used is referred to in the art as "blind" signal separation algorithms. Blind signal separation algorithms separate superimposed signals based on, for example, spectral differences or statistical independence between data streams. In the illustrated embodiment, such algorithms are modified so as to take as input a priori knowledge of the signals, and thus may be classified as "partially blind" or "semi-blind." A few examples of suitable signal separation algorithms that signal separator 730 may apply to the first linear combination LC1 when obtaining S1, S2, and S4 are described further below, following the description of the remainder of signal separator 730.

Performance monitor 740 is in operable communication with signal separator 730 and with channel estimator 720 (connection to channel estimator 720 not shown), and configured to determine whether channel estimator is effectively estimating the channel parameter(s) of signals S1, S2, and S4, as well as whether signal separator 730 is effectively separating those signals from one another.

Specifically, channel parameter module 741 of performance monitor 740 is configured to evaluate whether the estimated channel parameters of signals S1, S2, and S4 obtained by channel estimator 720 are stable. Stable signal parameters indicate that channel estimator 720 is effectively estimating channel parameters, while significant variations in the parameters indicate poor functioning of the estimator, and smaller random variations in the parameters indicate that signal power levels may be inadequate to perform the separation. If the parameters are stable, then performance monitor 740 outputs information to channel estimator 720 and/or signal separator 730 indicating that this aspect of obtained signals S1, S2, and S4 is satisfactory. If the parameters are not stable, then the performance monitor outputs information to channel estimator 720 and/or signal separator 730 indicating that this aspect of obtained signals S1, S2, and S4 is not satisfactory. On the basis of the output from performance monitor 740 regarding the quality of the channel parameters, channel estimator 720 may adjust one or more of the estimated channel parameters, and/or signal separator 730 may adjust one or more aspects of the algorithm that it applies to the linear combinations, so as to improve the quality of signal separation. Accordingly, in one embodiment the signal separator 730 obtains a matched filter response for each of the separated signals S1, S2, and S4, and the channel parameter module 741 determines the quality of that matched filter response.

Power level module 742 of the performance monitor 740 is configured to measure and evaluate the power levels of signals S1, S2, and S4 obtained by signal separator 730, as well as the estimated power levels of the channel parameters obtained by signal separator module 730. For example, power level module measures one or more of the total signal power, output power, and noise levels of obtained signals S1, S2, and S4. If power level module 742 determines that the sum of the signal and noise powers is less than the total power, for example, then module 742 determines that the signal separator has not achieved matched filter responses, such as where implementation loss is too high. In such a case, power level module 742 outputs information to signal separator 730 indicating that this aspect of obtained signals S1, S2, and S4 is not satisfactory. If the parameters are stable, then power level module 742 outputs information to signal separator 730 indicating that this aspect of obtained signals S1-S4 is satisfactory. Power level module 742 may also output information to channel estimator 720 regarding the power levels of the estimated channel parameters, which information channel estimator 720 may use in adjusting one or more of the estimated channel parameters.

Decision module 743 of performance monitor 740 is configured to attempt to decode codeword(s) embedded in signals S1, S2, and S4 obtained by signal separator 730, and to determine whether the codeword(s) are correctly decoded. If decision module 743 determines that individual codeword(s) are valid, then it may perform such an evaluation a second time to determine if the same codeword is decoded, so as to confirm whether the output of signal separator 730 is stable; and if such an evaluation is successful, decision module 743 outputs information to signal separator 730 indicating that this aspect of obtained signals S1, S2, and S4 is satisfactory. If the codeword(s) are not correctly decoded on either the first or second pass, then decision module 743 outputs information to signal separator 730 indicating that this aspect of the obtained signals is not satisfactory.

Thus, based on the outputs of the channel parameter module 741, power level module 742, and decision module 743, the channel estimator 720 may adjust one or more estimated channel parameters of S1, S2, or S4, and/or the signal separator 730 may modulate one or more aspects of the algorithm that it applies to the first linear combination LC1 when obtaining S1, S2, and S4. In one embodiment, signal separator 730 includes an algorithm to correct coding and interleaving of signals S1, S2, and S4, for example, to randomize potential burst errors.

It should be appreciated that signal separator module 632 illustrated in FIG. 7A and signal separation circuitry components 731, 732 may be implemented using any suitable combination of dedicated hardware and/or general purpose computing platforms having appropriate programming. For example, one or more components of the signal separator module 632 may be implemented using one or more programmable electronic circuits, such as programmable gate arrays (PGAs), application specific integrated circuits (ASICs), and/or processors, e.g., CPUs or GPUs. The programmable circuits may be programmed with associated software and/or firmware. In one embodiment, signal separator module 632 is implemented on a general-purpose computing platform, e.g., a personal computer (PC), that includes input ports 711, 712, output ports 701-704, a processor, and computer-readable memory storing instructions for causing the processor to execute the functionalities of channel estimator 720, signal separator 730, and performance monitor 740 as applied to both LC1 and LC2.

It will be appreciated, however, that other algorithms, including those not yet developed, may also suitably be used. For further details on examples of suitable systems and methods for separating signals from one another, see U.S. patent application Ser. No. 12/635,670, filed on Dec. 10, 2009 and entitled "Signal Separator," and U.S. patent application Ser. No. 13/156,128, filed on Jun. 8, 2011 and entitled "Methods and Systems for Increased Communication Throughput," the entire contents of both of which are incorporated by reference herein.

In one example, signal separator 730 includes a blind Viterbi detector implementing a block maximum likelihood algorithm that assumes that each individual signal is buried in Gaussian noise. In another example, signal separator 730 applies a joint maximum likelihood signal separation algorithm, which uses estimated channel parameters provided by the channel estimator 720 to construct a Viterbi algorithm procedure to separate signals S1-S4 from one another based on the first and second linear combinations. For further details on Viterbi decoders and algorithms, see U.S. Pat. No. 6,910,177 to Cox, the entire contents of which are incorporated by reference herein.

In still another example, signal separator 730 includes an independent component analysis (ICA) algorithm. An ICA algorithm typically views a composite signal in terms of a mixing matrix that combines superimposed signal components, and derives and applies to the composite signal a separation matrix that is the inverse of the mixing matrix, to separate the signal components. The signal separator 730 may use estimated channel parameters provided by the channel estimator 720 to construct and apply a dynamically tuned matched filter for each individual signal in the first and second linear combinations, for example using analog or digital (DSP) hardware or software. The signal separator 730 then may provide the matched filters as input to the ICA algorithm, which obtains a separation matrix based on the matched filters and provides as output individual signal components of the respective linear combination. Signal separator 730 further may provide these separated signal components to forward error correction (FEC) decoders, which use the components to obtain separated signals S1-S4. For further details on ICA algorithms, see "Blind Signal Separation: Statistical Principles," J. F. Cardoso, Proc. IEEE, pp. 2009-2025 (October 1998), and "ICAR: A Tool for Blind Source Separation Using Fourth-Order Statistics Only," L. Albera et al., IEEE Transactions on Signal Processing, pp. 3633-3643 (October 1995), the entire contents of both of which are incorporated by reference herein.

In still another example, signal separator 730 may include a maximum-a-posteriori—turbo equalizer algorithm. As described above, signal separator 730 may include an algorithm for constructing matched filters based on estimated channel parameters provided by channel estimator 720. Signal separator 730 may include a soft-in/soft-out (SISO) trellis equalizer that receives the outputs of the matched filters, and provides as output SISO signals. Signal separator 730 further may include SISO decoders that receive the SISO signals and provide as output separated signals S1-S4. The decoders also send information back to the SISO trellis equalizer for use in refining the SISO signals. Alternatively, signal separator 730 may include an oversampler, which samples the first and second linear combinations at rates greater than or equal to their baseband frequencies, e.g., using a suitable analog-to-digital converter. Signal separator 730 then provides the oversampled first and second linear combinations to the SISO trellis equalizer. The SISO trellis equalizer may implement a forward backward (FB) algorithm in obtaining the SISO signals, for example by iteratively comparing the confidence levels of adjacent bits, and probabilistically evaluating the individual bits in the SISO signals. For further details on maximum-a-posteriori—matched filter algorithms, see the following references, the entire contents of each of which are incorporated by reference herein: "A Tutorial on Hidden Markov Models and Selected Applications in Speech Recognition," L. R. Bahl et al., IEEE Tr. IT, 20:284-287 (March 1974); "Optimum Multiuser Detection," S. Verdu, Cambridge Univ. Press, Chapter 4, pp. 154-233 (1998); "Turbo Equalization," R. Koetter et al., IEEE SP Magazine, pp. 67-80 (January 2004); and "Turbo Equalization: Principles and New Results," M. Tuechler et al., IEEE Tr. Comm., 50:(5): 754-767 (May 2002).

For further details on signal separation algorithms, also see U.S. Pat. No. 6,026,121 to Sadjapour and U.S. Pat. No. 7,330,801 to Goldberg, the entire contents of both of which are incorporated by reference herein.

As mentioned above, a signal separator module such as illustrated in FIG. 7A may also be used in combination with a receiver polarization module such as illustrated in FIG. 5, so as to further enhance separation of the signals from one another. That is, in one embodiment, the output ports of a receiver polarization module may be coupled to the input ports of a signal separator module that performs processing analogous to that discussed above with respect to FIG. 7A to reduce or eliminate cross-coupling between the M signals, e.g., between S1, S2, S3, and S4.

It should be understood that the systems and methods described herein may be adapted for transmitting and/or receiving any desired number of non-orthogonally polarized signal components. For example, three, four, five, six, seven, eight, nine, ten, eleven, twelve, thirteen, fourteen, fifteen, sixteen, seventeen, eighteen, nineteen, twenty, or even more than twenty signals may be transmitted and/or received using the systems and methods provided herein. For embodiments in which networks of hybrid transformers are used to obtain and/or analyze first and second linear combinations of signals, it is particularly preferred that the number of signals be a power of two, because hybrid transformers are readily commercially available with two inputs and up to two outputs. However, hybrid transformers with three inputs and three outputs are also available. As such, any suitable combination of two- and three-input/output hybrid transformers may be used to construct a network configured to take as input any desired number of signals and to provide as output first and second linear combinations of those signals. Note that in some circumstances at least one signal component may be orthogonal to at least one other signal component, but the composite signal is considered "non-orthogonal" so long as it contains at least one signal component that is non-orthogonal to another signal component.

Figure 8:
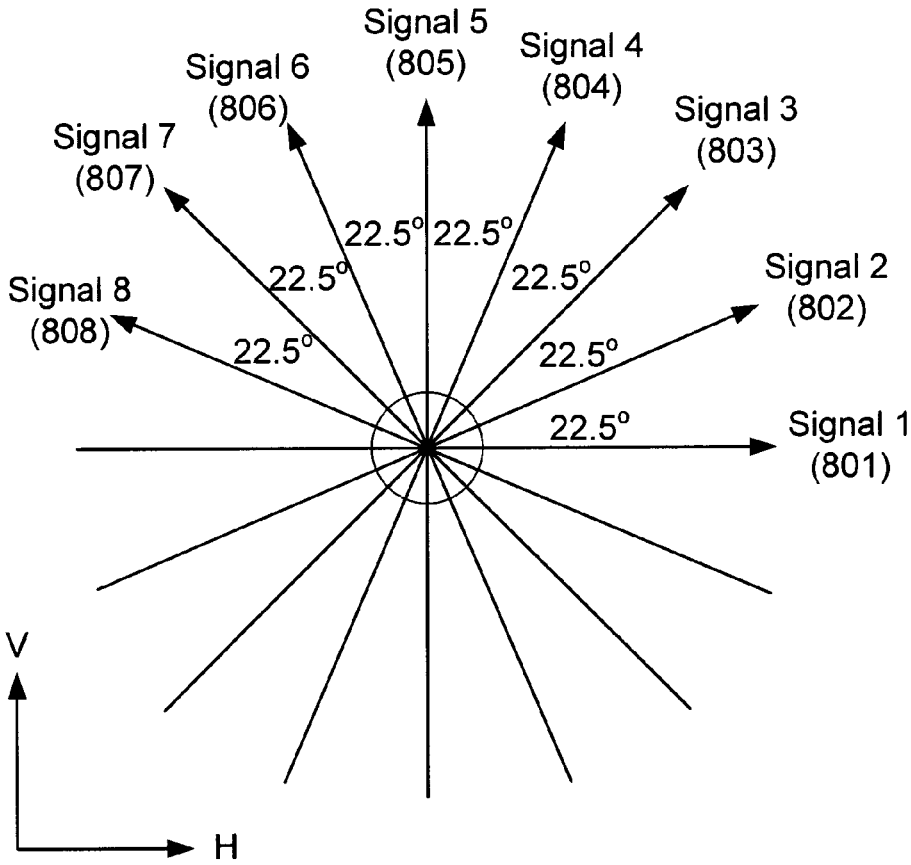
FIG. 8 schematically illustrates the polarizations of eight non-orthogonal signals transmitted and received using the communications system of FIG. 2, according to another exemplary embodiment of the present invention.

In one exemplary embodiment, as illustrated in FIG. 8, eight signals may be non-orthogonally transmitted by linearly combining those signals into first and second linear combinations, and respectively transmitting those linear combinations on first and second orthogonally polarized antenna ports (e.g., H and V). Specifically, the first and second linear combinations may be selected such that signal 1 (801) is transmitted at the H polarization, and signal 5 (805) is transmitted at the V polarization. The first linear combination, which is transmitted at the H polarization, contains a component of signal 1 but no component of signal 5, and as a result signal 5 has no H component and is entirely V polarized. Conversely, the second linear combination, which is transmitted at the V polarization, contains a component of signal 5 but no component of signal 1, and as a result signal 1 has no V component and is entirely H polarized. However, both of the first and second linear combinations contain components of signals 2, 3, 4, 6, 7, and 8, so each of these signals has components in both of the H and V directions, and are therefore non-orthogonal to the H and V directions. The relative proportions of each signal in the first and second linear combinations may be selected to provide any desired angular spacing between the signals, in this embodiment an even 22.5° spacing, although the spacing between signals need not be even.

Figure 9:
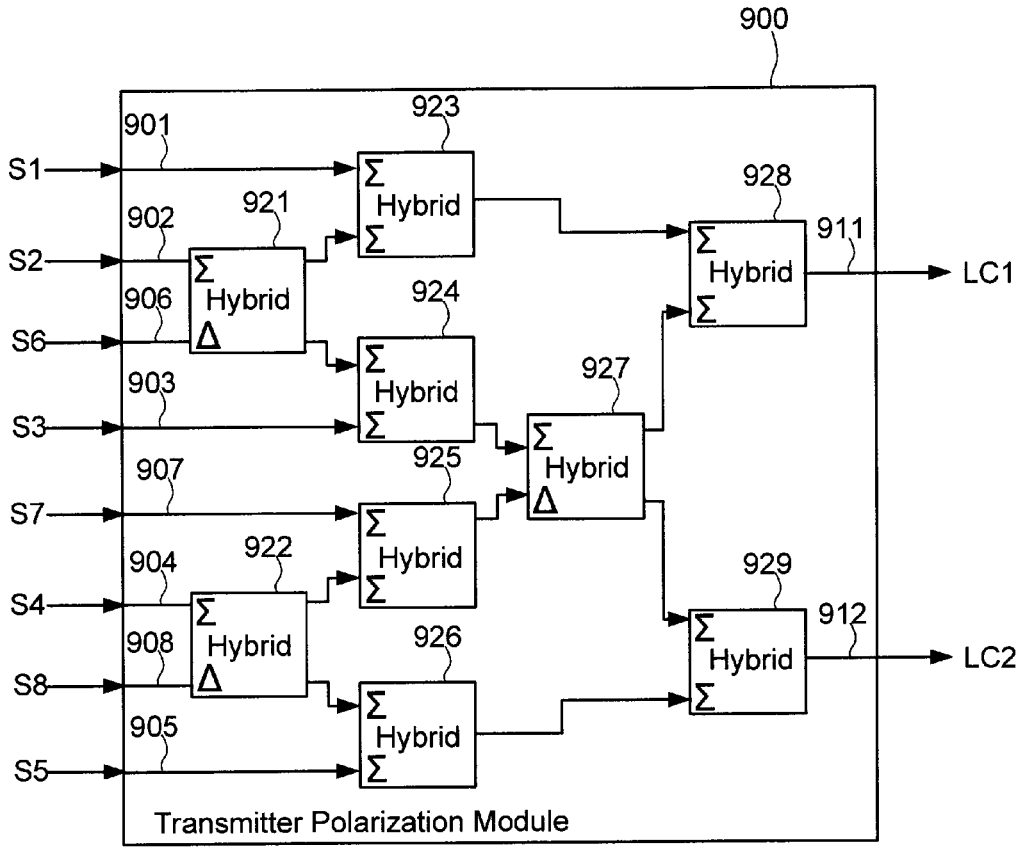
FIG. 9 schematically illustrates an alternative transmitter polarization module for use in the communications system of FIG. 2 or FIG. 6 and configured to process eight signals, according to one exemplary embodiment of the present invention.

FIG. 9 illustrates an exemplary transmitter polarization module 900 that may be used in a transmitter subsystem 210 such as illustrated in FIG. 2. Unlike the transmitter polarization module 212 illustrated in FIG. 4, which includes four input ports receiving as input four signals, here module 900 includes eight input ports 901-908 that receive eight signals S1-S8. Transmitter polarization module 900 also includes first and second output ports 911, 912, on which it outputs first and second linear combinations LC1, LC2 of the eight signals, to be transmitted using an antenna such as dual polarized antenna 213 illustrated in FIG. 2.

Transmitter polarization module 900 includes nine hybrid transformers 921-929 disposed between, and operably coupled to, input ports 901-908 and output ports 911, 912. In analogous fashion to module 212 illustrated in FIG. 4, the network of hybrid transformers 921-929 of module 900 obtains and outputs first and second linear combinations LC1, LC2 of signals S1-S8. As noted above with respect to FIG. 8, the first linear combination includes the full signal component of S1, no signal component of S5, and partial components of S2-S4 and S6-S8. The second linear combination includes the full signal component of S5, no signal component of S1, and partial components of S2-S4 and S6-S8. As described above with respect to FIG. 2, the output ports 911, 912 of transmitter polarization module 900 may be coupled to a transmission antenna configured to transmit the first and second linear combinations at polarizations orthogonal to one another, e.g., at H and V respectively. As discussed above with respect to FIGS. 2 and 5, a receiver subsystem 230 may include an analogous receiver polarization module 232 configured to perform inverse linear operations on the first and second linear combinations so as to separate S1-S8 from one another, optionally in combination with a signal separation module 233. Alternatively, as discussed above with respect to FIGS. 6 and 7, a receiver subsystem 630 may include an analogous signal separator module 632 configured to separate S1-S8 from one another based on a priori information about one or more of the signals, and on the first and second linear combinations. Such a signal separator module optionally could be used in combination with a receiver polarization module, as mentioned above.

Regardless of the particular number of non-orthogonal signals to be transmitted, the channel parameters of one or more of the signals may be selected to facilitate later separation of the signals. For example, as noted above for embodiments that include an adaptive cancellation module, CW tones or pseudorandom codes may also be uniquely added to each signal to facilitate signal component acquisition and tracking. In these embodiments, the transmitting and receiving systems each has a respective frequency reference so that carrier frequency differences between code components can be selected by design. In addition, code phase and bit timing differences between independent signal components can also be selected by design. Thus, channel parameter differences between signal components can be selected to facilitate signal acquisition and tracking. In practice, design attention to the amplitude and phase tracking of the passive and active electronics are required to maintain coherence in combining signal components.

For example, the separation of three signals that are modulated using quadrature phase shift keying (QPSK) may be facilitated by using the same carrier frequency for all signals and to select code phase differences between signal components by 60° relative to one another. This selection of code phase differences can be shown to maximize the symbol differences between signal components in their overall constellation. This approach as applied to the four polarization alignments in FIG. 1 using the two signal separation circuit components 731, 732 illustrated in FIG. 7A follows because the vertical and horizontal outputs of the receiving antenna each have three dominant signal components. Similarly, the separation of eight signals may be facilitated by grouping the signals into two groups of four, and setting the bit timing offset for each group to one half of the bit timing. Also, using a single signal carrier allows the transmitter antenna to be operated close to its saturated output, because intermodulation products are not produced by the signal carrier frequency. This increases the transmitter antenna's power efficiency and the power of the received signal, thus improving reception reliability.

While various illustrative embodiments of the invention are described above, it will be apparent to one skilled in the art that various changes and modifications may be made therein without departing from the invention. The appended claims are intended to cover all such changes and modifications that fall within the true spirit and scope of the invention.

What is claimed is:

1. A system for communicating three or more independent signals each generated by a respective source and sharing the same frequency bandwidth, the three or more independent signals not being coherently related with one another, the system comprising:

a transmitter subsystem comprising a transmitter polarization module and a transmitter antenna having first and second linearly polarized antenna ports, the transmitter polarization module comprising circuitry configured to obtain first and second combinations of the three or more independent signals and to respectively output the first and second combinations to the first and second antenna ports, the first and second combinations being different than one another and each of said combination comprises a different subset of said three or more independent signals, the first antenna port being configured to transmit the first combination at a first polarization and the second antenna port being configured to transmit the second combination at a second polarization orthogonal to the first polarization so as to generate three or more distinct non-orthogonal polarization components, each non-orthogonal polarization component transmitting one of the three or more independent signals.

2. The system of claim 1, wherein the first combination comprises a first part of a first signal of the three or more independent signals and the second combination comprises a second part of the first signal.

3. The system of claim 2, wherein the circuitry is configured to place the first and second parts out of phase with one another.

4. The system of claim 1, wherein the first and second combinations comprise different linear combinations of the three or more independent signals.

5. The system of claim 1, further comprising circuitry for modifying at least one channel parameter of each of the three or more independent signals so as to facilitate separation of the signals from one another by a receiver.

6. The system of claim 1, further comprising a receiver subsystem comprising a receiver antenna and receiver circuitry, the receiver antenna configured to receive the first and second transmitted combinations on first and second linearly polarized antenna ports and to output the first and second combinations respectively on first and second receiver output ports, and the receiver circuitry configured to receive the first and second combinations from the first and second receiver output ports and to obtain the three or more independent signals based on the received first and second combinations.

7. The system of claim 6, wherein the receiver circuitry comprises a signal separator module comprising a channel estimator and a signal separator, the channel estimator configured to store a priori data describing at least one channel parameter of at least one of the three or more independent signals and to dynamically estimate a channel parameter of the at least one of the three or more independent signals based on the a priori data, the signal separator configured to obtain the three or more independent signals based on the dynamically estimated channel parameter and the first and second combinations.

8. The system of claim 7, wherein the a priori data comprises information about a modulation format, code rate, bit rate, pulse shape, error correction code, interleaver description, preamble description, nominal carrier rate, or nominal data rate of the at least one of the three or more independent signals.

9. The system of claim 7, wherein the dynamically determined channel parameter comprises a carrier frequency, carrier phase, code phase, bit timing, signal amplitude, or data rate refinement.

10. The system of claim 1, wherein the circuitry comprises a network of hybrid transformers.

11. A method communicating three or more independent signals each generated by a respective source and sharing the same frequency bandwidth, the three or more independent signals not being coherently related with one another, the method comprising:

receiving the three or more independent signals;

obtaining first and second combinations of the three or more independent signals, the first and second combinations being different than one another and each of said combination comprises a different subset of said three or more independent signals; outputting the first and second combinations to first and second linearly polarized antenna ports of a transmitter antenna; and transmitting the first combination at a first polarization and transmitting the second combination at a second polarization orthogonal to the first polarization so as to generate three or more distinct non-orthogonal polarization components, each non-orthogonal polarization component transmitting one of the three or more independent signals.

12. The method of claim 11, wherein the first combination comprises a first part of a first signal of the three or more independent signals and the second combination comprises a second part of the first signal.

13. The method of claim 12, comprising placing the first and second parts out of phase with one another.

14. The method of claim 11, wherein the first and second combinations comprise different linear combinations of the three or more independent signals.

15. The method of claim 11, further comprising modifying at least one channel parameter of each of the three or more independent signals so as to facilitate separation of the signals from one another by a receiver.

16. The method of claim 11, further comprising:

receiving the first and second transmitted combinations on first and second linearly polarized receiver antenna ports and outputting the first and second combinations respectively on first and second receiver output ports, and receiving the first and second combinations from the first and second receiver output ports obtaining the three or more independent signals based on the received first and second combinations.

17. The method of claim 16, further comprising: storing a priori data describing at least one channel parameter of at least one of the three or more independent signals, dynamically estimating a channel parameter of the at least one of the three or more independent signals based on the a priori data, and obtaining the three or more independent signals based on the dynamically estimated channel parameter and the first and second combinations.

18. The method of claim 17, wherein the a priori data comprises information about a modulation format, code rate, bit rate, pulse shape, error correction code, interleaver description, preamble description, nominal carrier rate, or nominal data rate of the at least one of the three or more independent signals.

19. The method of claim 17, wherein the dynamically determined channel parameter comprises a carrier frequency, carrier phase, code phase, bit timing, signal amplitude, or data rate refinement.

20. The method of claim 11, wherein the first and second combinations are obtained using a network of hybrid transformers.

* * * * *